United States Patent [19]

Gadd et al.

[11] 3,971,089

[45] July 27, 1976

[54] SELF-ADJUSTING ROLL WIPERS FOR A SHOE LASTING MACHINE

[75] Inventors: Ronald O. C. Gadd, Leicester; Robert C. Quarmby, Groby; Frank R. Smith, Leicester, all of England

[73] Assignee: USM Corporation, Boston, Mass.

[22] Filed: Apr. 3, 1975

[21] Appl. No.: 564,673

[30] Foreign Application Priority Data

May 7, 1974 United Kingdom ..... 20175/74

[52] U.S. Cl. ..... 12/8.3

[51] Int. Cl.[2] ..... A43D 21/00

[58] Field of Search ..... 12/8.3

[56] References Cited

UNITED STATES PATENTS 3,758,902 9/1973 Gadd et al. ..... 12/8.3

3,803,654 4/1974 Henkel et al. ..... 12/8.3

3,849,818 11/1974 Brailsford et al. ..... 12/8.3

*Primary Examiner*—Patrick D. Lawson

*Attorney, Agent, or Firm*—Donald N. Halgren; Richard B. Megley; Vincent A. White

[57] ABSTRACT

A shoe lasting machine having helically landed rolls for wiping opposite margins of a shoe upper. The rolls extend widthwise of the shoe bottom and are supportively disposed so the roll surfaces facing the shoe bottom generally correspond to the widthwise curvature of the shoe bottoms, the rolls being arcuately movable, permitting a controllable change in the included angle therebetween in order that they may accommodate wide ranges of transverse curvatures of shoe bottoms.

5 Claims, 1 Drawing Figure

2
3
4
5
6
7
8
9
10
11
12
14
16
20
22
26
28
30
32
34
40
42
44
46
48

SELF-ADJUSTING ROLL WIPERS FOR A SHOE LASTING MACHINE

BACKGROUND OF THE INVENTION

1. Field of the Invention

This invention relates to shoe lasting machines and, more particularly, to shoe machines having rotatable rolls for wiping upper margins onto the shoe bottom.

2. Prior Art

In U.S. Pat. No. 3,908,216, filed on Apr. 10, 1974, and assigned to the present assignee of this invention, there is described a shoe lasting machine which is adapted to wipe an upper inwardly over a last bottom using a pair of driven rolls having helical lands. The rolls are carried on the machine so as to be permitted a bodily rocking movement in unison about an axis closely adjacent to and extending lengthwise of the shoe bottom.

The roll carrying arrangement comprises a carrier provided with a bearing member for each of the lasting rolls, the bearing members being adjustably mounted on the carrier so that the axes about which the rolls rotate may be manually adjusted in a plane extending generally transversely of the shoe assembly being operated upon. The carrier is guided for limited arcuate movement about an axis extending generally lengthwise of the bottom of the shoe assembly in a support which is mounted for movement toward and away from the bottom of the shoe assembly. The axes about which the rolls rotate are inclined at angles so that the wiping portions of the lasting rolls lie at a slight angle such that the rolls will wipe marginal portions of the opposite sides of the upper, the entire carrier rocking slightly about an axis extending lengthwise of the bottom of the shoe assembly. The angular relation between the rolls must be manually adjusted according to the shoes to be operated upon.

In U.S. Pat. No. 3,000,024, there is described a shoe machine for simultaneously lasting, trimming and roughing a shoe. The machine is provided with a generally cylindrically shaped rotating tool for lasting a shoe bottom supported by a carriage that may rise and fall controllably in a generally vertical plane. This machine does not provide for any roll adjustment to accommodate widthwise curvature of the shoe bottom.

An object of the present invention is to provide a shoe lasting arrangement having wiping rolls that may controllably rise and fall generally vertically, and that may also automatically change their axes of rotation with respect to one another to permit effective wiping of shoe bottoms irrespective of any undulations or curvature of shoe bottoms and irrespective of varying widths of any one or any number of shoe bottom styles.

SUMMARY OF THE INVENTION

The present invention provides, in accordance with one of its several features, an improved shoe upper conforming machine for simultaneously lasting opposite side portions of shoes in at least the waist region thereof. The machine comprises means for supporting a shoe assembly (comprising a shoe upper and insole mounted upon a last within the upper) and means for causing the shoe supporting means to position a shoe assembly placed thereon in position to be operated upon by lasting instrumentalities of the machine. The lasting instrumentalities comprise a pair of frusto-conically shaped rotatable lasting rolls which are arranged to operate simultaneously to wipe marginal portions of the upper at opposite sides of the shoe assembly inwardly with respect to the insole so that the marginal portions of the upper and insole may become secured together by adhesive applied therebetween. Means are provided for effecting relative movement lengthwise of the shoe assembly between the lasting rolls and the shoe supporting means to cause the rolls progressively to operate along side portions of the shoe assembly. Each of the lasting rolls has a helical wiping element and is supported by carrying means so that axes about which the rolls rotate extend substantially widthwise of the shoe assembly being operated upon. Each roll carrying means is mounted for arcuate movement about an axis extending generally lengthwise of the bottom of the shoe assembly, and comprises a carrier provided with a bearing member for the associated lasting roll. The machine also has means for adjustably determining the angular disposition of one of said carriers with respect to the other about said lengthwise axis to accommodate varying widthwise bottom curvatures while permitting the two carriers together to partake of bodily arcuate movement about that axis to accommodate variable twisting of the shoe bottom from horizontal.

Each carrier is provided with an arm connected with means for predetermining the angular disposition of one arm with respect to the other. To this end there is provided a piston and cylinder arrangement connected between the two arms to move the arms between positions determined by adjustable stop means. The piston and cylinder arrangement may be connected to a control circuit arrangement including valve means actuated as a consequence of the relative movement occurring between the lasting rolls and the shoe supporting means lengthwise of the shoe.

The present invention therefore improves the lasting action of the lasting rolls and minimizes any risk of portions of the lasting rolls marking the upper in regions which might otherwise show in the finished shoe.

BRIEF DESCRIPTION OF THE DRAWING

The objects and advantages of the present invention will become more apparent when viewed in conjunction with the drawing, in which.

DESCRIPTION OF THE PREFERRED EMBODIMENT

Figure 1:
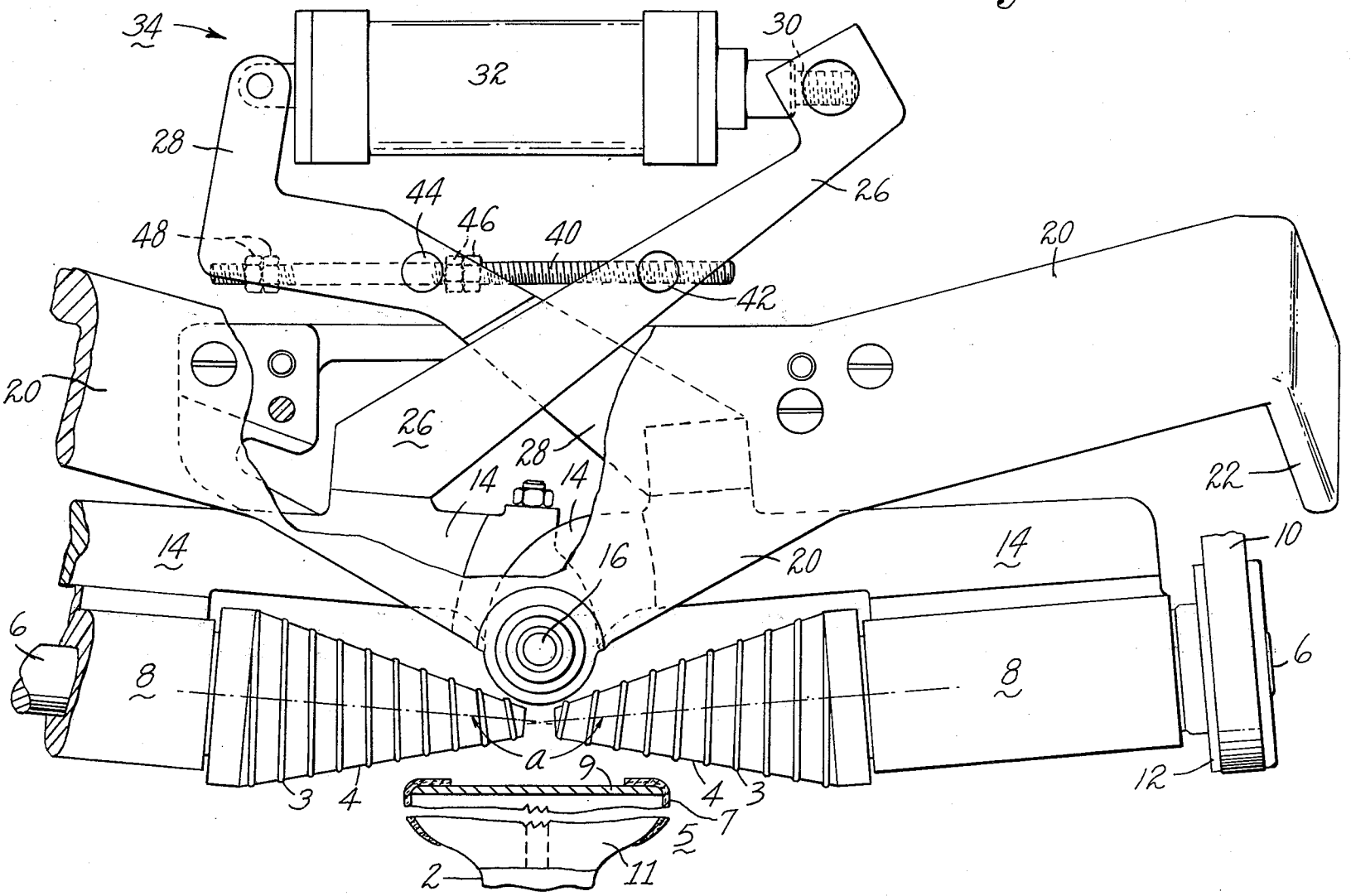
FIG. 1 is a partial front elevational view of the lasting rolls and support arrangement constructed according to the principles of the present invention.

A typical machine in which the invention may be used comprises a shoe upper conforming machine for simultaneously lasting opposite side portions of shoes in the shank region such as that described in said copending application. Such a machine usually includes shoe supporting means 2 for a shoe assembly 5 comprising a shoe upper 7 and an insole 9 mounted on a last 11. The lasting instrumentalities, shown in FIG. 1, may comprise a pair of generally frusto-conically shaped lasting rolls 4 arranged to wipe the margins of the shoe upper at opposite sides of the shoe assembly inwardly over the insole for attachment, for example, by an adhesive applied continuously along the margin of said insole.

Each roll 4 has a shaft 6 driven by a belt 10 and a pulley 12 from a motor, not shown, so that each of the rolls 4 may rotate continuously during operation of the machine. Each roll 4 typically may be provided with an arrangement of helically disposed lands 3 or wiping elements of opposite hand from that disposed on the other roll.

Each shaft 6 is mounted in a bearing block 8 secured to a roll carrier arm 14 pivoted on a common pivot pin 16 which extends lengthwise of the shoe being operated upon at a level just above the shoe bottom and centrally disposed with respect to inner end portions of the rolls 4, as shown in FIG. 1. The pin 16 is carried by a support member 20 which is fixed on front end portions of a pair of arms 22, rearward ends of which are pivotally supported upon a cross shaft which is supported by a frame portion, not shown, of the machine, permitting rising and falling movements of the rolls. The rolls 4 may be urged toward the shoe bottom during the lasting operation by means of a piston and cylinder arrangement acting on the arms such as that shown in said application.

Extending upwardly and crosswise from each roll carrier 14 is an arm 26, for the left hand carrier 14 as seen in FIG. 1, and an arm 28, for the right hand carrier 14. The arms 26, 28 cross over, as seen in the FIG. 1 drawing, and upper end portions of the arms 26, 28 are connected to a piston rod 30 and cylinder 32 of a piston and cylinder arrangement 34. The piston and cylinder arrangement 34 provides means for adjustably determining the angular disposition of one of said carriers 14 with respect to the other about the pin 16, while permitting the two carriers together to partake of arcuate movement about that axis. The piston and cylinder arrangement 34 is arranged to move the arms 26, 28 between positions determined by adjustable stop means which comprises a stop rod 40, one end portion of which is threaded into a pin 42 in the arm 26 and the other end portion of which extends freely through a similar pin 44 carried by the other arm 28. Two sets of lock nuts 46, 46 and 48, 48 threaded on to the rod 40 adjustably determine the limits of movement which can be imparted to the arms 26, 28 under the influence of the piston and cylinder arrangement 34.

The piston and cylinder arrangement 34 may be connected in a control circuit arrangement (not shown) of the machine which may include valve means for controlling the supply of fluid (e.g. air) under pressure to the cylinder 32 so that, in one position of the valve means, the piston rod 30 is extended from the cylinder 32 to swing the arms 26, 28 outwardly, to a limit set by engagement of the pin 44 with the stop nuts 48, to change the angle, as shown in the drawing, between the axes of the lasting rolls to an amount suitable for the rolls to operate in a more transversely curved region of the shoe bottom. In the other position of the valve means, the piston rod 30 is drawn inwardly with respect to the cylinder 32 to swing the arms 26, 28 inwardly to a limit set by engagement of the pin 44 with the stop nuts 46, to increase the angle *a* between the axes of the lasting rolls to an amount suitable for the rolls 4 to operate in a relatively flat region of the shoe bottom.

Since there may well exist a difference in transverse curvature of the shoe bottom, as between the forepart region and the seat region for example, the valve means may be operated as a consequence of movement of the shoe supporting means 2 as it traverses the shoe assemblies beneath the lasting rolls during the lasting operation. To this end a triggering device, not shown, may be appropriately positioned on the machine frame in a direction extending lengthwise of the shoe assembly. It will be appreciated that during the lasting operation the lasting roll assembly may tilt as a whole about the axis of the pin 16 to equalize the roll pressure at opposite sides of the shoe bottom despite any "twist" that may occur in the general plane of the shoe bottom, considered about an axis extending generally lengthwise of the shoe assembly, as is the case of the machine disclosed in said copending application. It will furthermore be understood that the air pressure supplied to the piston and cylinder arrangement 34 will be sufficient to avoid individual displacement of the roll axes about the pivot pin 16 under the action of downward pressure of the rolls upon the shoe bottom. With the arrangement above described it is therefore possible to positively "program" or automatically change the relative disposition of the roll axes by control of angle *a* during a side lasting operation to suit changes in transverse curvature of portions of the shoe bottom successively engaged by the rolls.

It will be apparent that while we have shown and described our invention in a preferred form, changes may be made in the structure shown without departing from the scope of the invention as sought to be defined by the following claims:

We claim:

1. A shoe upper conforming machine for simultaneously lasting opposite side portions of shoes in at least the waist region thereof, said machine comprising:

a pair of lasting rolls which are arranged to operate simultaneously to wipe marginal portions of an upper at opposite sides of a shoe assembly inwardly over the last bottom;

said rolls being relatively movable lengthwise of a shoe to cause the rolls progressively to operate along side portions of a shoe assembly;

each of said lasting rolls being supported by a roll carrying means so that axes about which said rolls rotate extend at least substantially widthwise of any shoe assembly being operated upon, wherein each of said roll carrying means is capable of individual programmable arcuate movement about an axis extending generally lengthwise of the bottom of said shoe assembly;

each of said rolls having a carrier provided with a bearing member for its associated lasting roll; and said machine also having fluid pressure operated means for varying the angular disposition of one of said carriers with respect to the other on a common support about said axis extending generally lengthwise of the bottom of said shoe assembly while permitting both of said carriers together to partake of said arcuate movement about said axis.

2. A shoe upper conforming machine as recited in claim 1, wherein each of said carriers is provided with an arm connected with means for predetermining the angular disposition of one arm with respect to the other.

3. A shoe upper conforming machine as recited in claim 2, where there is provided a piston and cylinder arrangement connected between each of said arms to move said arms between positions determined by an adjustable stop means.

4. A shoe upper conforming machine as recited in claim 2 wherein each roll is generally frusto-conically shaped, and each roll has a generally helically disposed land thereon, each of opposite hand from one another.

5. A shoe upper conforming machine for simultaneously lasting opposite side portions of shoes, said machine comprising:

means for supporting a shoe assembly, said shoe assembly comprising a shoe upper mounted upon a last;

a pair of lasting rolls arranged to operate simultaneously to wipe marginal portions of said upper at opposite sides of said shoe assembly inwardly, said rolls having a common support means being relatively movable lengthwise of a shoe on said shoe support to cause said rolls progressively to operate along said side portions of said shoe assembly, each of said rolls being carried by a roll carrying means so that the axes about which said rolls rotate extend at least substantially widthwise of said shoe assembly being operated upon, wherein each of said roll carrying means is capable of individual arcuate movement about an axis extending generally lengthwise of the bottom of said shoe assembly;

each of said rolls having a carrier provided with a bearing member for its associated lasting roll; and, said machine having fluid pressure operated means for varying the angular disposition of one of said carriers with respect to the other about said axis extending generally lengthwise of the bottom of said shoe assembly while permitting both of said carriers together on said common support to partake of said arcuate movement about said axis.

* * * * *